US007686418B2

(12) United States Patent
Ha

(10) Patent No.: US 7,686,418 B2
(45) Date of Patent: Mar. 30, 2010

(54) INKJET IMAGE FORMING APPARATUS HAVING A CAPPING UNIT

(75) Inventor: Dong-woo Ha, Suwon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 734 days.

(21) Appl. No.: 11/522,946

(22) Filed: Sep. 19, 2006

(65) Prior Publication Data

US 2007/0126778 A1 Jun. 7, 2007

(30) Foreign Application Priority Data

Dec. 2, 2005 (KR) ..... 10-2005-0116893

(51) Int. Cl.
*B41J 2/165* (2006.01)
*B41J 2/155* (2006.01)

(52) U.S. Cl. ..... 347/29; 347/32; 347/31; 347/42

(58) Field of Classification Search ..... 347/24, 347/29, 30, 31, 32, 33, 35, 36, 42
See application file for complete search history.

(56) References Cited

U.S. PATENT DOCUMENTS 5,680,162 A * 10/1997 Taylor et al. ..... 347/35
6,578,945 B2 * 6/2003 Hashi et al. ..... 347/22
7,195,334 B2 * 3/2007 Nakamura ..... 347/29
7,311,375 B2 * 12/2007 Suzuki et al. ..... 347/29

FOREIGN PATENT DOCUMENTS

| | | | |
|---|---|---|---|
| EP | 1 405 725 | * | 4/2004 |
| EP | 1 493 584 | * | 1/2005 |
| JP | 07-025007 | | 1/1995 |
| JP | 10-181040 | * | 7/1998 |
| JP | 2002-292886 | | 10/2002 |
| JP | 2004-74637 | | 3/2004 |
| JP | 2004-230745 | | 8/2004 |
| JP | 2004-237691 | | 8/2004 |
| JP | 2004-330644 | | 11/2004 |

OTHER PUBLICATIONS

Korean Office Action dated Nov. 15, 2006 issued in KR 2005-116893.

* cited by examiner

*Primary Examiner*—Shih-wen Hsieh
(74) *Attorney, Agent, or Firm*—Stanzione & Kim, LLP

(57) ABSTRACT

An inkjet image forming apparatus includes an inkjet head having a nozzle unit having a length in a main scanning direction corresponding to a width of a printing medium, a capping unit to move to a capping position to cap the nozzle unit and an uncapping position for a printing. The capping unit includes a cap member having a spitting hole and covering the nozzle unit, an absorbing member to absorb an ink passing through the spitting hole, and a support member disposed at a position where the cap member and the absorbing member are installed, the support member receiving the ink spitted.

7 Claims, 8 Drawing Sheets

INKJET IMAGE FORMING APPARATUS HAVING A CAPPING UNIT

CROSS-REFERENCE TO RELATED APPLICATIONS

This application claims priority under 35 U.S.C. §119(a) from Korean Patent Application No. 10-2005-0116893, filed on Dec. 2, 2005, in the Korean Intellectual Property Office, the disclosure of which is incorporated herein in its entirety by reference.

BACKGROUND OF THE INVENTION

1. Field of the Invention

The present general inventive concept relates to an inkjet image forming apparatus and a maintenance method thereof, and more particularly, to an inkjet image forming apparatus employing an array inkjet head having a nozzle unit having a length corresponding to a width of a printing medium in a main scanning direction, and a preliminary spitting method thereof.

2. Description of the Related Art

Inkjet image forming apparatuses form an image by firing ink from an inkjet head (e.g., shuttle type inkjet head) onto a sheet of paper while reciprocating the inkjet head in a main scanning direction and feeding the paper in a subscanning direction. For high speed printing, recent inkjet image forming apparatuses use an inkjet head (e.g., array inkjet head) with a nozzle unit having a length corresponding to a width of the paper in the main scanning direction instead of using the shuttle type inkjet head. In these inkjet image forming apparatuses, the array inkjet head is fixed, and only the paper is fed in the subscanning direction. Therefore, the inkjet image forming apparatus can have a simple driving mechanism and provide the high speed printing. In these inkjet image forming apparatuses, when a printing margin in a width direction of the A4 size paper is not considered, the nozzle unit is about 210 mm long so as to correspond to the width of A4 the size paper. Viscosity of ink should be kept in an appropriate state for printing. If the printing is not performed for a while, moisture of ink in the nozzle is vaporized and therefore the viscosity of ink increases. Also, while the printing is performed, the moisture of the ink in the nozzle that does not participate in the printing is vaporized and therefore the viscosity of the ink increases. Under this circumstance, ink may not be ejected from the nozzle. To prevent this, a preliminary spitting that before a printing is performed or after a predetermined amount of printing is performed, ink is spitted a few times to remove the ink with a high viscosity is performed. At this time, fog (particles) of the spitted ink is dispersed into an inside of the inkjet image forming apparatus. The shuttle type inkjet head has a few tens of nozzles while the array type inkjet head has more than a few thousands of nozzles. In the case of the array type inkjet head, the fog of ink may be generated so much, which may contaminate an inside of the image forming apparatus.

SUMMARY OF THE INVENTION

The present general inventive concept provides an inkjet image forming apparatus employing an array inkjet head that can be prevented from being contaminated by particles occurring due to preliminary spitting, and a preliminary spitting method thereof.

Additional aspects and advantages of the present general inventive concept will be set forth in part in the description which follows and, in part, will be obvious from the description, or may be learned by practice of the general inventive concept.

The foregoing and/or other aspects of the present general inventive concept may be achieved by providing an inkjet image forming apparatus including an inkjet head having a nozzle unit having a corresponding to a width of a printing medium in a main scanning direction, and a capping unit to move to a capping position to cap a nozzle of the nozzle unit and an uncapping position for a printing. The capping unit includes a cap member having a spitting hole and covering the nozzle unit, an absorbing member to absorb an ink passing through the spitting hole, and a support member disposed at a position where the cap member and the absorbing member are installed, the support member receiving the ink spitted.

The nozzle unit may include a plurality of head chips each having a plurality of nozzles, and the spitting hole of the cap member may be formed in plural to correspond to the respective head chips. The cap member may include an outer wall completely enclosing the nozzle unit and an inner wall formed along an edge of the plurality of spitting holes. The capping unit further may include an elastic member providing the cap member with an elastic force in a direction to contact the nozzle unit. The capping unit further may include a cap plate to evenly support the cap member.

The support member may include an ejecting hole through which the ink is ejected. The above inkjet image forming apparatus may further include an ejecting pump to eject the ink collected in the support member to a waste ink storage container.

The above inkjet image forming apparatus may further include a platen which faces the nozzle unit to support a rear surface of the printing medium and has a penetration part such that the capping unit can access to the nozzle unit.

The above inkjet image forming apparatus may further include a platen which moves to a printing position to face the nozzle unit to support a rear surface of the printing medium and a maintenance position to escape from the printing position.

The foregoing and/or other aspects of the present general inventive concept may also be achieved by providing a preliminary spitting method in an inkjet image forming apparatus including an inkjet head having a nozzle unit having a length in a main scanning direction corresponding to a width of a printing medium, the method including capping the nozzle unit using a capping unit to isolate the nozzle unit from an exterior atmosphere, and preliminarily spitting an ink into the capping unit one or more times to remove the ink solidified in a nozzle of the nozzle unit.

The preliminary spitting method may include moving a platen to a position that does not interfere with the capping unit, the platen facing the nozzle unit to support a rear surface of the printing medium.

The foregoing and/or other aspects of the present general inventive concept may also be achieved by providing an inkjet image forming apparatus including an inkjet head having a nozzle unit to eject ink, and a capping unit to cap the nozzle unit; and a controller to control the nozzle unit to perform a preliminary spitting of the ink when the capping unit caps the nozzle unit.

BRIEF DESCRIPTION OF THE DRAWINGS

These and/or other aspects and advantages of the present general inventive concept will become apparent and more readily appreciated from the following description of the embodiments, taken in conjunction with the accompanying drawings of which.

DETAILED DESCRIPTION OF THE PREFERRED EMBODIMENTS

Figure 1:
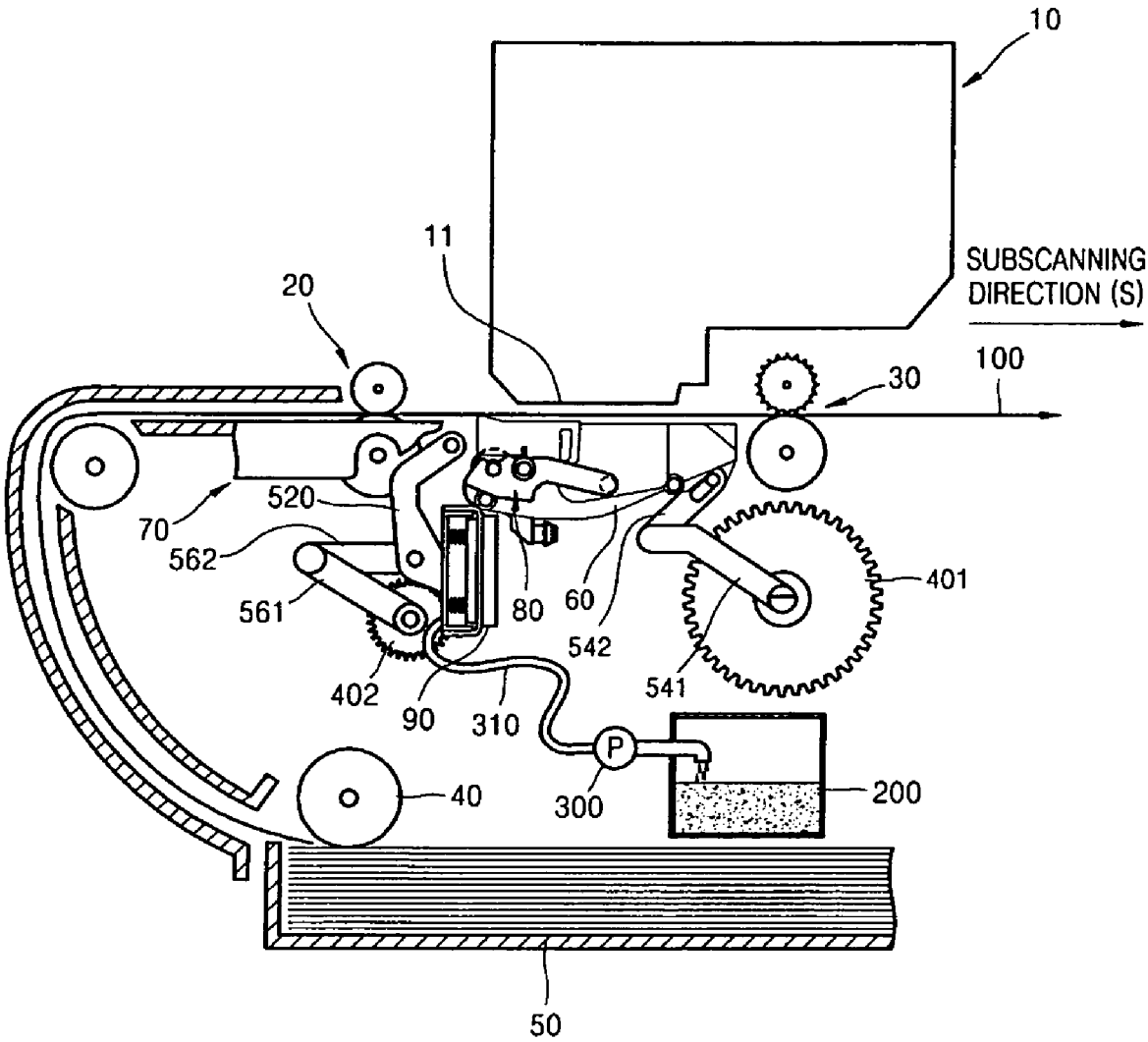
FIG. 1 is a schematic view illustrating an inkjet image forming apparatus employing an array type inkjet head according to an embodiment of the present general inventive concept.

Reference will now be made in detail to the embodiments of the present general inventive concept, examples of which are illustrated in the accompanying drawings, wherein like reference numerals refer to the like elements throughout. The embodiments are described below in order to explain the present general inventive concept by referring to the figures.

FIG. 1 is a schematic view illustrating an inkjet image forming apparatus employing an array type inkjet head according to an embodiment of the present general inventive concept. Referring to FIG. 1, a printing medium, such as a sheet of paper 100, picked up by a pickup roller 40 from a feeder cassette 50 is transferred in a subscanning direction 'S' by a transfer unit 20. An inkjet head 10 is disposed above the paper 100. The inkjet head 10 has a nozzle unit 11 having a length corresponding to a width of the paper 100 in a main scanning direction 'M', and is an array type inkjet head to spray ink onto the paper 100 at a fixed position to form an image. A discharge unit 30 discharges the paper 100 printed.

Figure 2:
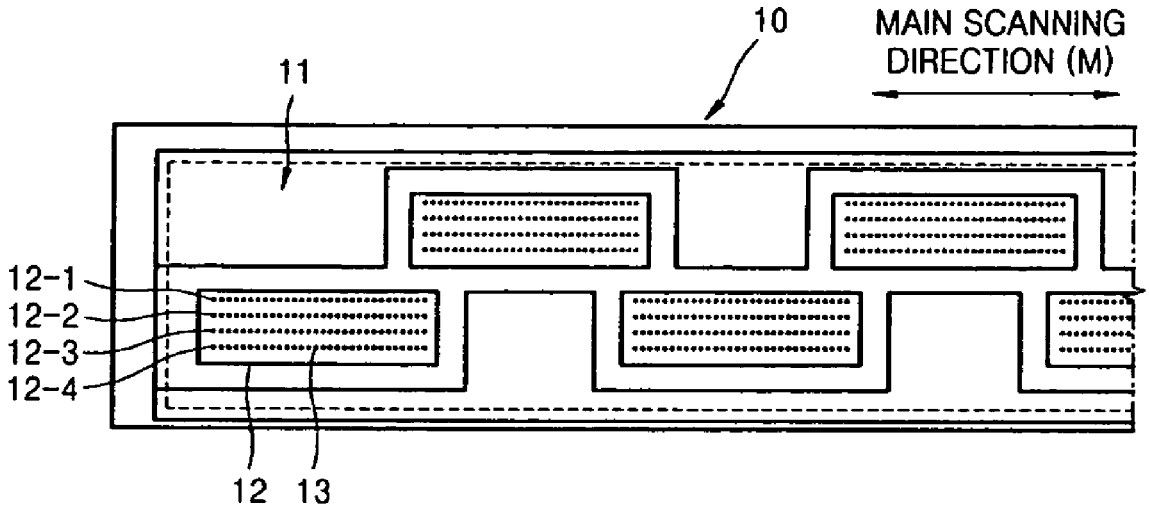
FIG. 2 is a schematic view illustrating an example of a nozzle unit of the array type inkjet head of FIG. 1.

FIG. 2 is a schematic view illustrating an example of the nozzle unit 11 of the array type inkjet head of in FIG. 1. Referring to FIG. 2, the nozzle unit 11 includes a plurality of head chips 12 arranged in a zigzag configuration in the main scanning direction 'M'. Each of the plurality of head chips 12 has a plurality of nozzles 13 to eject ink. The plurality of nozzles 13 of each head chip 12 are arranged in the form of a plurality of nozzle columns (lines) 12-1, 12-2, 12-3 and 12-4 each including the nozzles 13. The respective nozzle columns 12-1, 12-2, 12-3 and 12-4 can spray inks having the same or different colors (e.g., cyan, magenta, yellow, black), respectively. Although FIG. 2 shows one example of the nozzle unit 11, it can be understood that the present general inventive concept is not limited to the nozzle unit 11 of FIG. 2. Although not illustrated in the drawings, the inkjet head 10 includes a chamber having an ejecting member (e.g., Piezo element, heater) communicating with each of the plurality of nozzles 13 to provide a pressure for an ink ejection, and an ink passage through which the ink is fed to the chamber. Since the chamber, the ejecting member, and the ink passage are well known to those skilled in the art, their detailed description will be omitted.

Referring back to FIG. 1, a platen 60 is disposed to face the nozzle unit 11 and supports a rear surface of the paper 100. The platen 60 is positioned such that the nozzle unit 11 of the inkjet head 10 is spaced apart by a predetermined interval, for example, 0.5-2 mm, from the paper 100.

Figure 3:
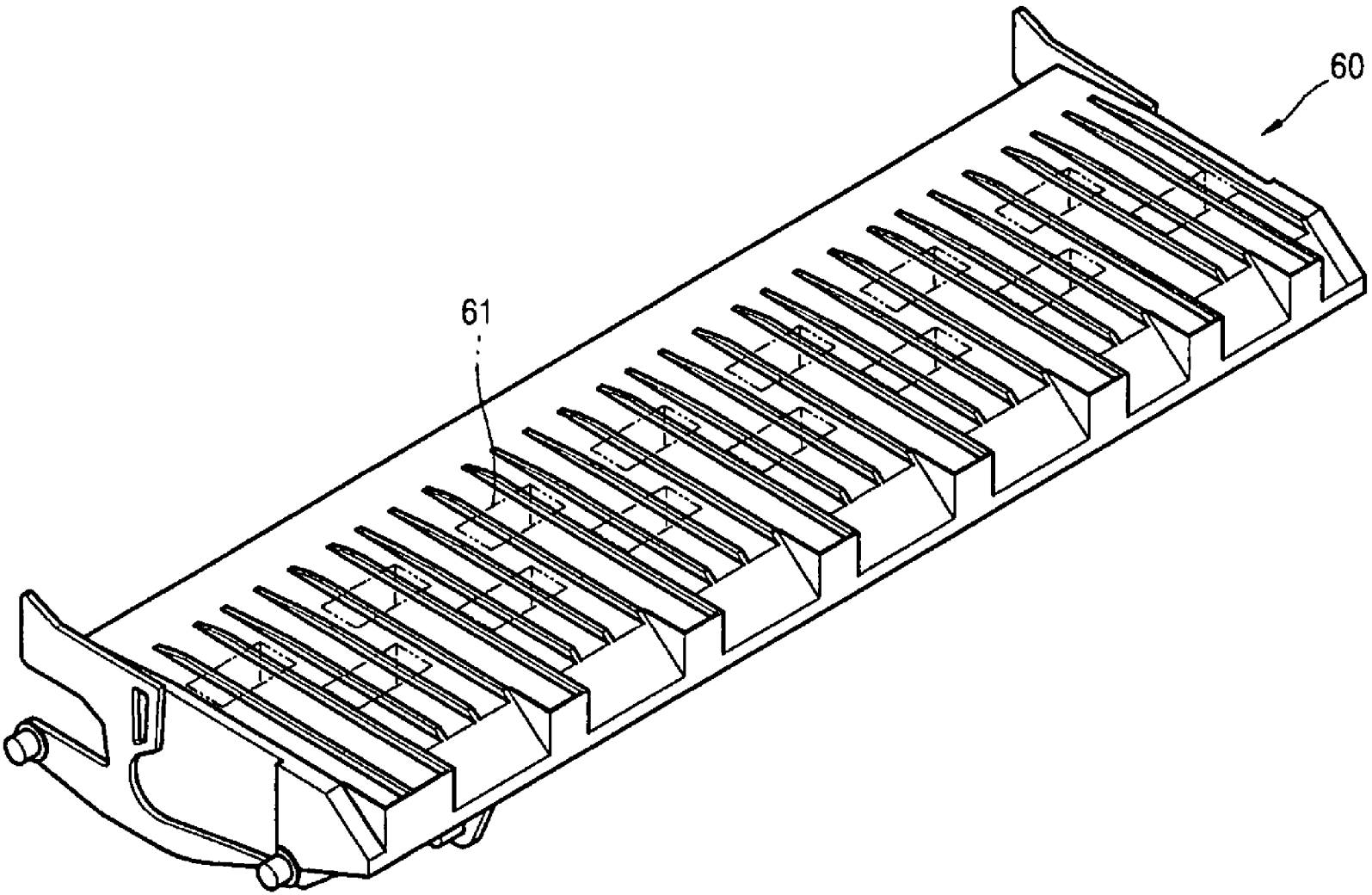
FIG. 3 is a perspective view illustrating a platen of the inkjet image forming apparatus of FIG. 1.

FIG. 3 is a perspective view illustrating the platen 60 of the inkjet image forming apparatus of FIG. 1. Referring to FIGS. 1 and 3, to receive ink preliminarily spitted, the platen 60 can include a receiving part 61 to receive ink spitted in a another spitting operation as illustrated as a dotted line. In this case, an interior of the image forming apparatus may be contaminated due to a fog of the ink spitted. To prevent the contamination due to the fog of ink, the image forming apparatus (particle), according to the present embodiment includes a capping unit 90 as illustrated in FIG. 1, and the nozzle unit 11 is capped using the capping unit 90 to be isolated from an exterior, and then a preliminary spitting is performed.

Figure 4:
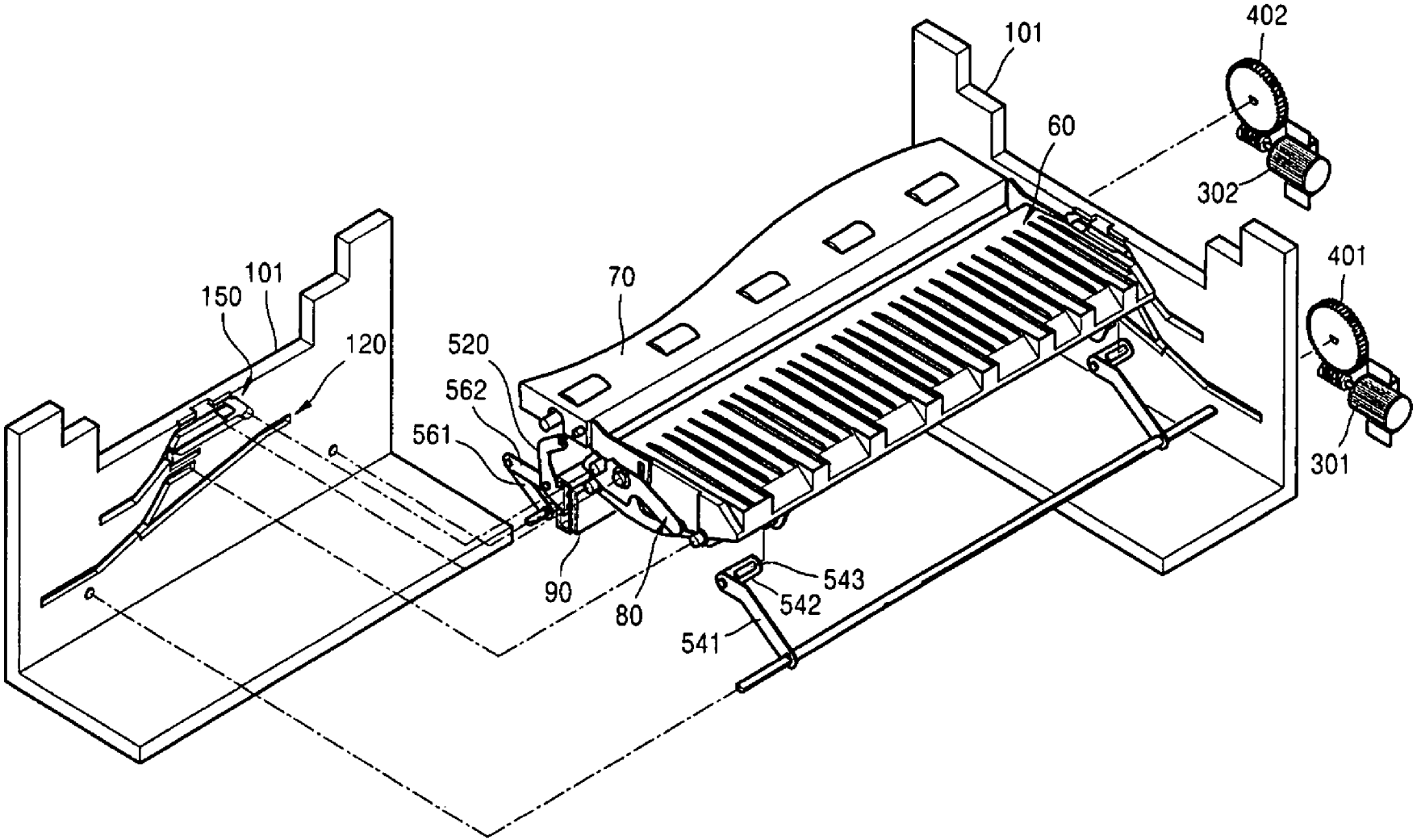
FIG. 4 is an exploded perspective view illustrating the inkjet image forming apparatus employing the array type inkjet head of FIG. 1.
Figure 7:
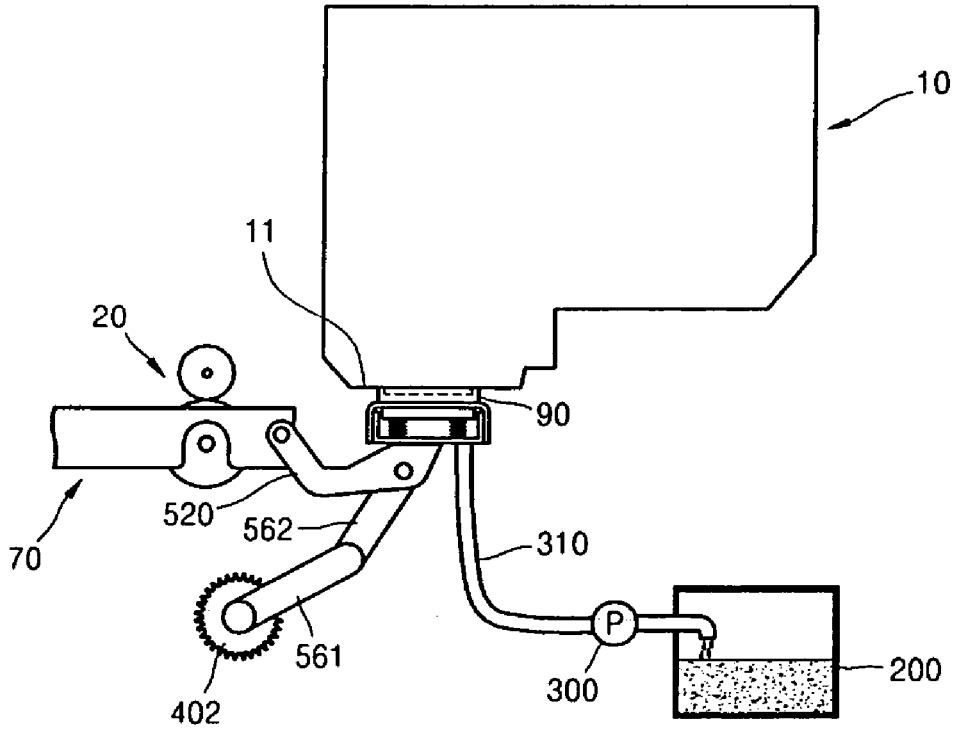
FIG. 7 is a side view illustrating a nozzle unit capped by a capping unit.

FIG. 4 is an exploded perspective view of the inkjet image forming apparatus of FIG. 1. Referring to FIGS. 1 and 4, the capping unit 90 is coupled with a cap arm 520. The cap arm 520 is rotatably installed in a guide member 70 to guide the paper 100 under the nozzle unit 11. Two connection arms 561 and 562 connect the cap arm 520 and a gear 402 which is rotated by a cap motor 302. As the cap motor 302 rotates clockwise or counterclockwise, the capping unit 90 moves to an uncapping position (FIG. 1) and a capping position (FIG. 7).

Figure 5:
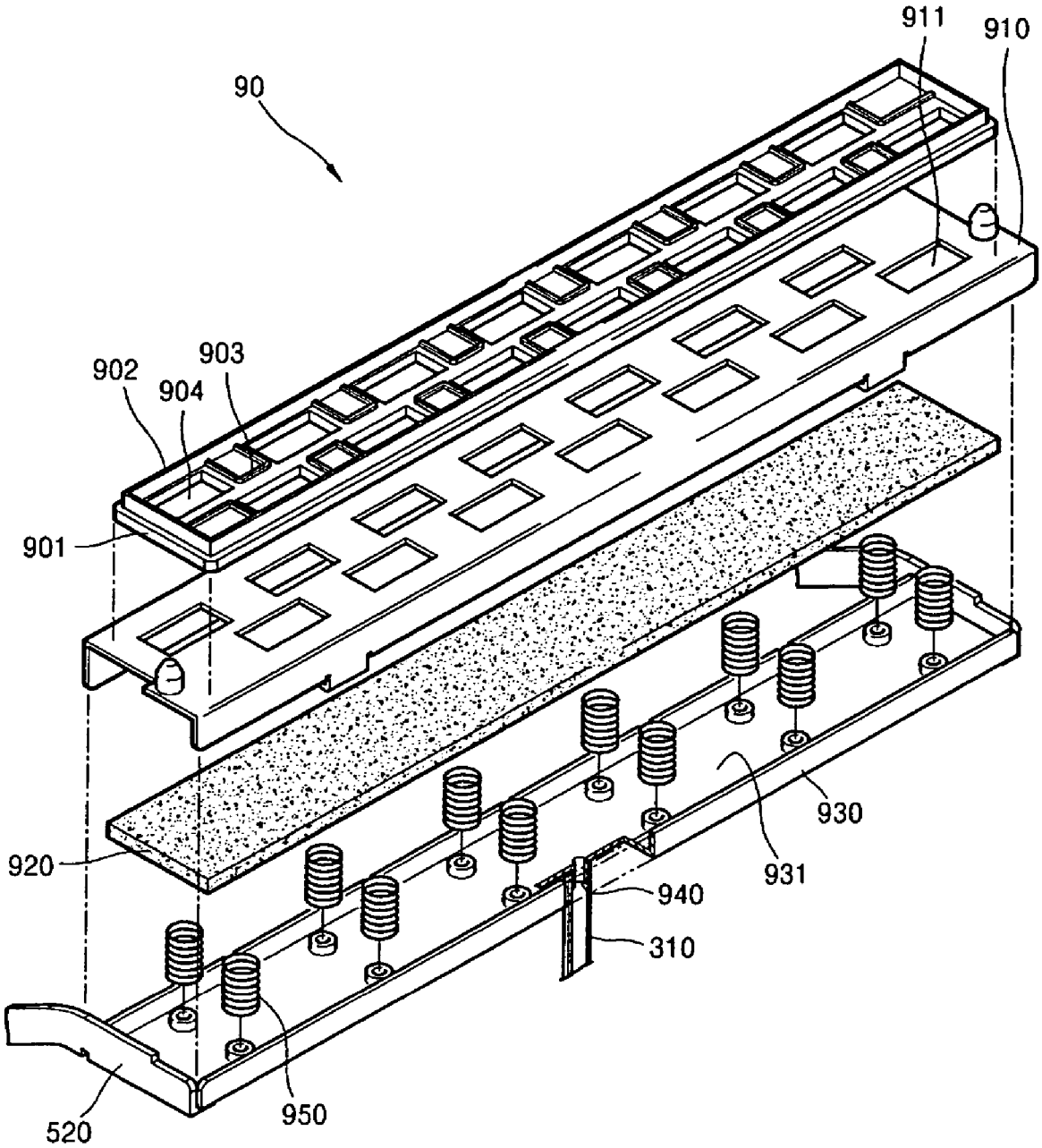
FIG. 5 is an exploded perspective view illustrating a capping unit of the inkjet image forming apparatus of FIG. 1 according to an embodiment of the present general inventive concept.

FIG. 5 is an exploded perspective view illustrating the capping unit 90 of FIG. 1. Referring to FIGS. 1, 4, and 5, the capping unit 90 includes a cap member 901 to cover the nozzle unit 11, and an absorbing member 920 disposed below the cap member 901 to absorb ink flowing out of the nozzle unit 11 or preliminarily spitted ink. The cap member 901 may be made of, for example, an elastic material, such as rubber. The absorbing member 920 can be made of, for example, felt or sponge.

The cap member 901 includes an outer wall 902 to closely contact the nozzle unit 11 and to completely enclose the nozzle unit 11. The cap member 901 includes a plurality of spitting holes 904. Although one spitting hole can fully cover all the head chips 12, one spitting hole may cover one or at least two head chips 12 so as to maintain flatness of the cap member 901. Each of the plurality of spitting holes 904 corresponds to each of the plurality of head chips. The cap member 901 can further include an inner wall 903 formed protruding along an edge of the plurality of spitting holes 904. The inner wall 903 may be equal in height to or lower than the outer wall 902. The inner wall 903 prevents the preliminarily spitted ink fog (particle) from contaminating a region other than a region of the nozzle unit 11 where the head chip is disposed, and also serves as a strength reinforcing rib to prevent the flatness of the cap member 901 from being deteriorated due to the spitting holes 904. In order to closely contact the nozzle unit 11 and completely isolate the nozzle unit 11 from an exterior atmosphere, the cap member 901 should be flattened, or a top portion of the outer wall 902 or the inner wall 903 may be required to be flattened. When the cap member 901 is made of an elastic material, the cap member 901 may be coupled to a flat cap plate 910 made of, for example, plastic or metal. The cap plate 910 may be provided with a plurality of through holes 911 corresponding to the plurality of spitting holes 904.

A support member 930 supports the cap member 901 and the absorbing member 920 and also receives the preliminarily spitted ink. Although the present embodiment shows that the support member 930 is integrally formed with the cap arm 520, the present general inventive concept is not limited thereto. The support member 930 may be provided with an ejecting hole 940 to eject ink. In order that the ink is naturally ejected through the ejecting hole 940, a bottom surface 931 of the support member 930 may be inclined toward the ejecting hole 940. As illustrated in FIGS. 1 and 4, an ejecting tube 310 connects the ejecting hole 940 with a waste ink storage container 200. Also, an ejecting pump 300 pumping waste ink to the waste ink storage container 200 may be further provided. In addition, the capping unit 90 can include an elastic member 950 pushing the cap member 901 toward the nozzle unit 11 such that an impact applied to the nozzle unit 11 in the capping operation is absorbed and the cap member 901 closely contacts the nozzle unit 11.

Figure 6:
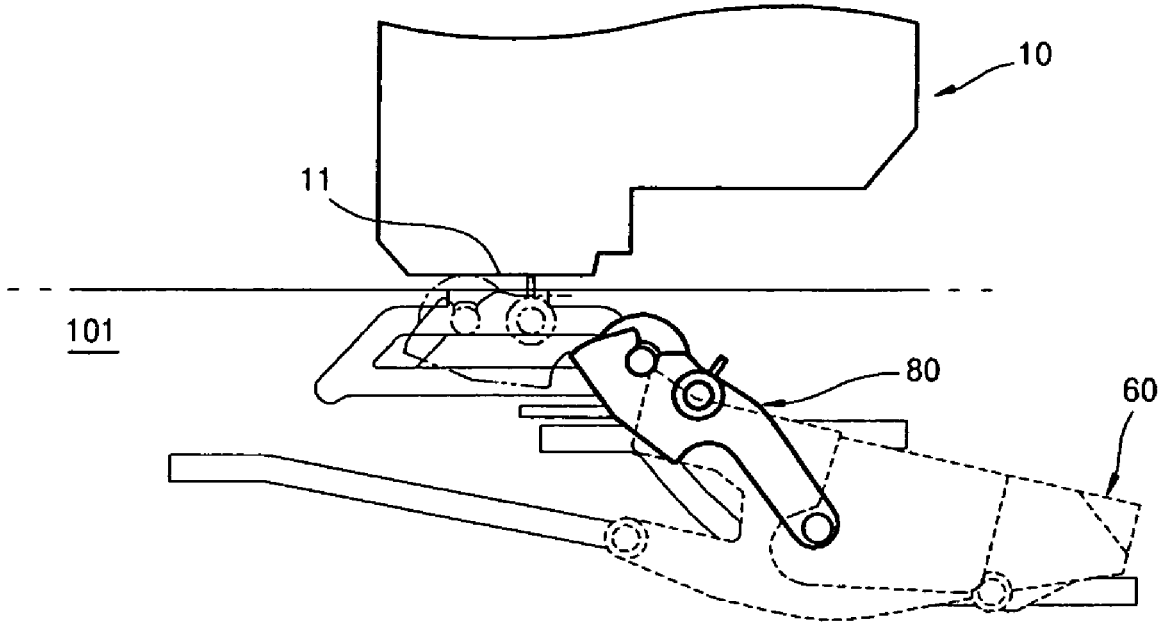
FIG. 6 is a schematic view illustrating a platen positioned at a maintenance position.

The platen 60 moves to a printing position to face the nozzle unit 11 to support the rear surface of the paper 'P' and a maintenance position to escape or spaced-apart from the printing position for the capping. For this purpose, as illustrated in FIGS. 1 through 4, a connection arm 541 is coupled with a gear 401 rotated by a maintenance motor 301. A second connection arm 542 is connected with the connection arm 541 and the platen 60. The second connection arm 542 is connected to the platen 60 through a connector 543. A guide rail 120 is provided in a frame 101 to support and guide the platen 60. As the maintenance motor 301 rotates clockwise or counterclockwise, the platen 60 is guided by the guide rail 120 and moves to the printing position (FIG. 1) and the maintenance position (FIG. 6). The image forming apparatus can further include a wiping unit 80 for cleaning the nozzle unit 11. The wiping unit 80 is coupled with the platen 60 and moves with the platen 60. The wiping unit 80 is guided by a wiping rail 150. By the above construction, it is possible to get rid of foreign substances attached on the nozzle unit 11 using the wiping unit 80 while to move the platen 60 to the printing position and the maintenance position as illustrated in FIG. 6.

A preliminary spitting method will now be described with the aforementioned construction.

Whenever a new print command is inputted from a host computer (not shown) or when a print command is inputted from the host computer (not shown) but the image forming apparatus does not perform a printing operation and a standby time exceeds a set reference standby time, or after a printing operation corresponding to a preset amount is performed, the preliminary spitting is performed.

First, when the printing is not performed for a long time, the nozzle unit 11 is in a state capped by the capping unit 90 as illustrated in FIG. 7, and under this capped state, the preliminary spitting is performed.

Figure 8:
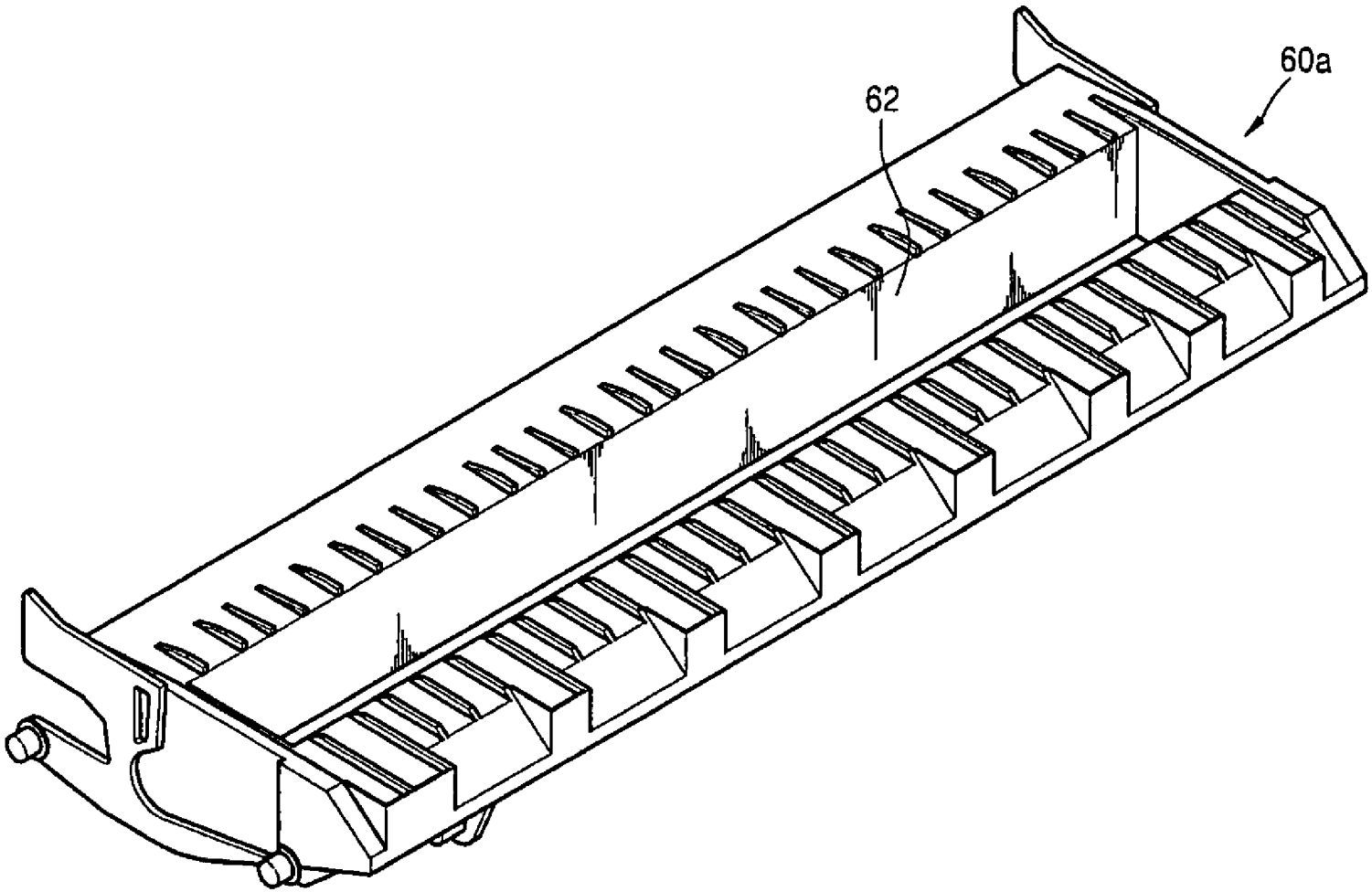
FIG. 8 is a perspective view illustrating another example of the platen shown in FIG. 1.

When the preset amount of printing has been completed in the printing operation, the cap member 901 is positioned at the uncapping position as shown in FIG. 1 and the platen 60 is positioned at the printing position. As illustrated in FIG. 8, when a platen 60*a* having a penetration part 62 through which the capping unit 90 passes is employed in the image forming apparatus, the cap motor 302 is rotated without the platen 60*a* moving, to cap the nozzle unit 11 and then the preliminary spitting is performed as shown in FIG. 7. When the platen 60 of FIG. 3 is employed, the maintenance motor 301 is rotated to move the platen 60 to the maintenance position as illustrated in FIG. 6. Thereafter, the cap motor 302 is rotated. While the capping unit 90 approaches the nozzle unit 11, the outer wall 902 and the inner wall 903 contact the nozzle unit 11, and the nozzle unit 11 is capped as illustrated in FIG. 7. The elastic member 950 pushes the cap member 901 toward the nozzle unit 11 such that the cap member 901 closely contacts the nozzle unit 11. In this state, the preliminary spitting is performed.

The spitted ink drops into the absorbing member 920 through the spitting hole 904 and is absorbed or received in the support member 930. Waste ink is ejected to the waste ink storage container 200 through the ejecting hole 940 and the ejecting tube 310. The ejecting pump 300 can operate while the preliminary spitting is performed or when after the preliminary spitting is performed, the capping unit 90 returns to the uncapping position, or when the number of the preliminary spitting as counted reaches a predetermined value.

As described above, after the nozzle unit 11 is capped, the preliminary spitting is performed to prevent the ink fog generated in the preliminary spitting operation from being dispersed into the inside and contaminating the image forming apparatus.

After the preliminary spitting is completed, the platen 60 returns to the printing position as illustrated in FIG. 1. At this time, the wiping unit 80 removes the foreign substances attached on the nozzle unit 11 as illustrated in a double dotted line in FIG. 5.

When the printing is not performed, the nozzle unit 11 is capped using the capping unit 90 such that the ink of the nozzle unit 11 is not solidified. When an inner space defined by the nozzle unit 11 and the cap member 901 is saturated due to moisture of the ink vaporized from the nozzle unit 11, the moisture of the ink is not further vaporized. Accordingly, the nozzle unit 11 is prevented from being dried. By making a height of the inner wall 903 equal to that of the outer wall 902 to decrease the volume of the inner space, it is possible to more rapidly saturate the inner space. Also, since moisture can be supplemented into the inner space by the ink absorbed into the absorbing member 920, the inner space is more rapidly saturated. Accordingly, it is possible to decrease a vaporized amount of the moisture of the ink from the nozzle unit 11 after the capping is performed, which helps to prevent the nozzle unit 11 from being dried. Furthermore, in order to more rapidly saturate the inner space, the ink may be spitted a few times after the nozzle unit 11 is capped.

Figure 9:
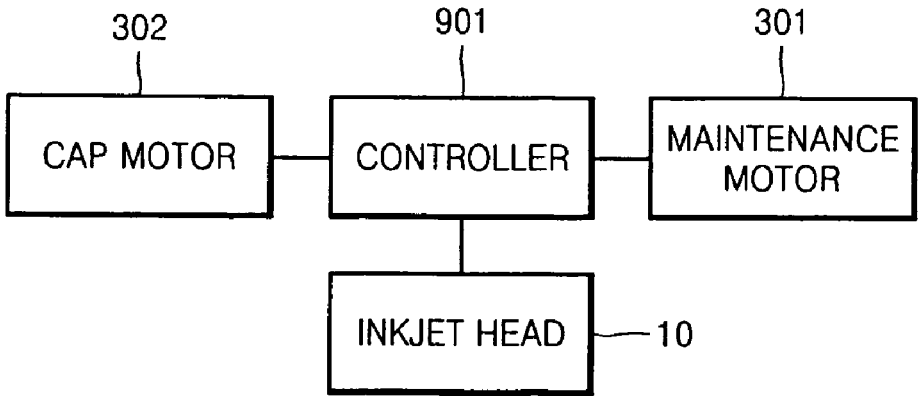
FIG. 9 is a block diagram illustrating the inkjet image forming apparatus of FIGS. 1 and 4.

FIG. 9 is a block diagram illustrating the inkjet image forming apparatus of FIGS. 1 and 4. Referring to FIGS. 1, 4, and 9, a controller 901 controls the maintenance motor 301 to move the platen 60 between the maintenance position and the printing position, the cap motor to move the cap member 90 between the cap position and the uncap position, and the nozzle unit 11 of the inkjet head 10 to perform a preliminary spitting operation according to at least one of a capping operation of the cap member 90, a location of the cap member 90, and a period of time of the cap operation or a printing operation. It is possible that the controller 901 can control the nozzle unit 11 to perform another spitting operation when the capping unit is not in the cap position.

Figure 10:
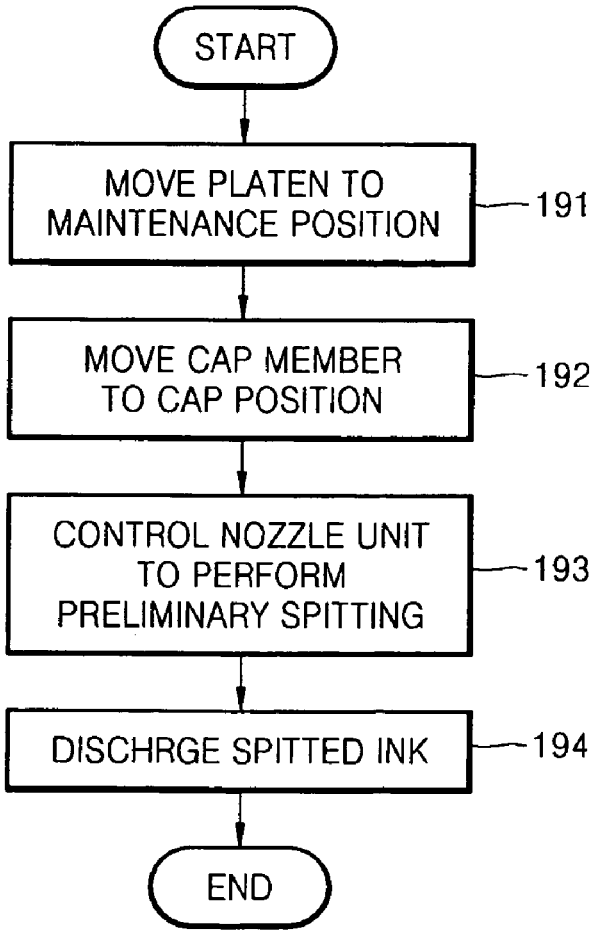
FIG. 10 is a flowchart illustrating a method of performing a preliminary spitting according to an embodiment of the present general inventive concept.

FIG. 10 is a flowchart illustrating a method of performing a preliminary spitting operation in an inkjet image forming apparatus according to an embodiment of the present general inventive concept. Referring to FIGS. 1, 4 and 10, the platen 60 and the cap member 90 move to the maintenance position and the cap position at operations 191 and 192, respectively. A controller controls the nozzle unit 11 of the inkjet head 10 to perform a preliminary spitting operation according to a cap operation of the cap member 90 at operation 193. the spitted ink contained in the cap member 90 is discharged at operation 194.

According to the image forming apparatus of the present embodiment, since the capping unit 90 having the absorbing member 920 receiving the preliminarily spitted ink is provided to reduce the amount of ink spitted so as to rapidly saturate the inner space or to be free of the ink spitted, the amount of the ink not used in printing but wasted can be reduced.

Although a few embodiments of the present general inventive concept have been shown and described, it will be appreciated by those skilled in the art that changes may be made in these embodiments without departing from the principles and spirit of the general inventive concept, the scope of which is defined in the appended claims and their equivalents.

What is claimed is:

1. An inkjet image forming apparatus comprising:

an inkjet head having a nozzle unit having a length in a main scanning direction corresponding to a width of a printing medium; and a capping unit to move to a capping position to cap the nozzle unit and an uncapping position for a printing, wherein the capping unit comprises:

a cap member having a spitting hole and covering the nozzle unit;

an absorbing member to absorb an ink passing through the spitting hole; and a support member disposed at a position where the cap member and the absorbing member are installed, the support member receiving the ink spitted the nozzle unit comprises a plurality of head chips each having a plurality of nozzles, and the spitting hole of the cap member is formed in plural to correspond to the respective head chips, and the cap member comprises an outer wall to enclose the nozzle unit and an inner wall formed along an edge of the respective spitting holes.

2. The inkjet image forming apparatus of claim 1, wherein the capping unit further comprises an elastic member to provide the cap member with an elastic force in a direction contacting the nozzle unit.

3. The inkjet image forming apparatus of claim 1, wherein the capping unit further comprises a cap plate disposed between the cap member and the absorbing member to evenly support the cap member, wherein the cap plate has a plurality of through holes corresponding to the plurality of spitting holes.

4. The inkjet image forming apparatus of claim 1, wherein the support member comprises an ejecting hole through which the ink is ejected.

5. The inkjet image forming apparatus of claim 4, further comprising:

an ejecting pump to eject the ink collected in the support member to a waste ink storage container.

6. The inkjet image forming apparatus of claim 1, further comprising:

a platen which faces the nozzle unit to support a rear surface of the paper and has a penetration part such that the capping unit can access to the nozzle unit.

7. The inkjet image forming apparatus of claim 1, further comprising:

a platen which moves to a printing position to face the nozzle unit to support a rear surface of the printing medium and a maintenance position different from the printing position.

* * * * *